US010197931B2

(12) United States Patent
Cohen et al.

(10) Patent No.: US 10,197,931 B2
(45) Date of Patent: Feb. 5, 2019

(54) ELECTROPHOTOGRAPHIC VARNISH

(71) Applicant: HP Indigo B.V., Amstelveen (NL)

(72) Inventors: Haim Cohen, Modiin (IL); Guy Nesher, Nes Ziona (IL); Getahun Biadglin, Beth-She'an (IL); Tony Azzam, Nazareth (IL); Ilanit Mor, Kiryat Ono (IL); Samer Farran, Nes Ziona (IL); Yael Kowal-Blau, Givataim (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/520,179

(22) PCT Filed: Oct. 24, 2014

(86) PCT No.: PCT/EP2014/072916

§ 371 (c)(1),
(2) Date: Apr. 19, 2017

(87) PCT Pub. No.: WO2016/062359

PCT Pub. Date: Apr. 28, 2016

(65) Prior Publication Data

US 2018/0074420 A1 Mar. 15, 2018

(51) Int. Cl.

| | |
|---|---|
| ***G03G 8/00*** | (2006.01) |
| ***G03G 9/13*** | (2006.01) |
| ***G03G 9/135*** | (2006.01) |
| ***G03G 15/10*** | (2006.01) |

(52) U.S. Cl.

CPC ..... *G03G 8/00* (2013.01); *G03G 9/131* (2013.01); *G03G 9/1355* (2013.01); *G03G 15/10* (2013.01)

(58) Field of Classification Search

CPC ..... G03G 9/131; G03G 9/135; G03G 9/12; G03G 9/1355

USPC ..... 430/126.1, 114, 115, 112

See application file for complete search history.

(56) References Cited

U.S. PATENT DOCUMENTS

| | | | | |
|---|---|---|---|---|
| 4,845,144 | A | 7/1989 | Piccirilo | |
| 6,348,292 | B1 * | 2/2002 | Pan | G03G 9/135 399/251 |
| 7,396,401 | B2 | 7/2008 | Jungnitz et al. | |
| 7,632,562 | B2 | 12/2009 | Nair et al. | |
| 8,404,411 | B2 | 3/2013 | Mitsumori et al. | |
| 8,633,958 | B2 | 1/2014 | Kawahara et al. | |
| 2003/0047589 | A1 * | 3/2003 | Fujii | H01L 21/67109 228/122.1 |
| 2007/0120922 | A1 | 5/2007 | Lebelle et al. | |
| 2011/0108865 | A1 * | 5/2011 | Aldaz | H01L 33/60 257/98 |
| 2013/0288175 | A1 * | 10/2013 | Chun | G03G 13/10 430/112 |
| 2013/0323426 | A1 | 12/2013 | Kaczun et al. | |

FOREIGN PATENT DOCUMENTS

| | | | |
|---|---|---|---|
| EP | 2437121 | | 4/2012 |
| JP | 2000-235284 A | * | 8/2000 |
| WO | WO-2012105952 | | 8/2012 |

OTHER PUBLICATIONS

ESPACENET machine-assisted English-language translation of JP 2000- 235284 A (pub. Aug. 2000).*

International Search Report and Written Opinion for International Application No. PCT/EP2014/072916 dated Jun. 23, 2015, 8 pages.

* cited by examiner

*Primary Examiner* — Janis L Dote

(74) *Attorney, Agent, or Firm* — Dierker & Kavanaugh PC

(57) ABSTRACT

A transparent electrophotographic varnish composition comprises a charge adjuvant and inorganic filler particles. A method of manufacturing an electrophotographic varnish composition comprises heating a thermoplastic resin mixture until the resin has melted; cooling the resin mixture to form resin particles; contacting the resin particles with a charge adjuvant and inorganic filler particles to form composite particles or a mixture of particles; and combining the composite particles or particulate mixture with a carrier fluid to form the electrophotographic varnish composition. A liquid electrophotographic printing system and a print substrate are also provided.

17 Claims, No Drawings

ELECTROPHOTOGRAPHIC VARNISH

BACKGROUND

Electrophotographic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrophotographic ink composition including charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

DETAILED DESCRIPTION

Before the present disclosure is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which the polymers, particles, colorant, charge directors and other additives can be dispersed to form a liquid electrophotographic ink or electrophotographic varnish. A mixture of a variety of different agents, such as surfactants, co-solvents, viscosity modifiers, and/or other possible ingredients, may be dispersed or dissolved in the carrier liquid.

As used herein, "electrophotographic ink composition", which may be termed an "electrostatic ink composition", generally refers to an ink composition, which may be in liquid or powder form. The composition is suitable for use in an electrophotographic printing process, sometimes termed an electrostatic printing process. The electrophotographic ink composition may include chargeable particles of a resin, which may be as described herein, dispersed in a carrier liquid, which may be as described herein.

As used herein, "electrophotographic varnish composition", which may be termed an "electrostatic varnish composition", generally refers to a varnish composition, which is typically in liquid form and suitable for use in an electrostatic or electrophotographic printing (i.e. electrophotographic digital printing). The electrophotographic varnish composition is typically applied to an electrophotographically printed image to protect the image and/or set its optical appearance, for example, with a matt or gloss finish. The electrophotographic varnish composition may be applied to the entire substrate or, more commonly, to selected areas of the substrate, for example, solely to the printed areas or selected areas of the substrate that include the printed areas. The electrophotographic varnish composition may include chargeable particles of a resin, which may be as described herein, dispersed in a carrier liquid, which may be as described herein. The electrophotographic varnish composition is transparent and may be substantially devoid of colorant (e.g. dye or pigment). The electrophotographic varnish may be printed electrophotographically over one or more layers of electrophotographically printed ink, for example, in the same print cycle.

As used herein, the term "transparent" is used to describe a composition that allows light to pass therethrough. In the context of an electrophotographic varnish composition, the term "transparent" may mean that the composition allows light to pass through it such that, when the electrophotographic varnish composition is electrographically printed over a printed image of at a thickness of 3 μm or less, for instance, 1.5 to 2 μm (e.g. 1.5 μm), the printed image is clearly visible to the naked eye. In some examples, the electrophotographic varnish composition is transparent, whereby, when the electrophotographic varnish composition is electrographically printed over a printed image of at a thickness of 1.5 μm, the change in optical density of the varnished image is within +/−0.05 of the optical density of the un-varnished image. Additionally or alternatively, the electrophotographic varnish composition is transparent, whereby, when the electrophotographic varnish composition is electrographically printed over a printed image of at a thickness of 1.5 μm, the colours in the varnished image are substantially the same as the colours in the unvarnished image. In some examples, the difference in the colour(s) of the varnished and un-varnished image are small. Reference is made to ASTM D1729-96 (Reapproved 2009, which specifies the equipment and procedures for visual appraisal of colours and colour differences of opaque materials that are diffusely illuminated. In some examples, the delta E (determined according to CIE94) between the colours of the varnished and un-varnished image may be 3 or less, for example, 2 or less. In some examples, the delta E (determined according to CIE94) may be 1.5 or less, for example, 1 or less.

Optical density or absorbance is a quantitative measure expressed as a logarithmic ratio between the radiation falling upon a material and the radiation transmitted through a material.

$$A_\lambda = -\log_{10}\left(\frac{I_1}{I_0}\right),$$

where $A_\lambda$ is the absorbance at a certain wavelength of light ($\lambda$), $I_1$ is the intensity of the radiation (light) that has passed through the material (transmitted radiation), and $I_0$ is the intensity of the radiation before it passes through the material (incident radiation). The incident radiation may be any suitable white light, for example, day light or artificial white light. The optical density or delta E of an image may be determined using methods that are well-known in the art. For example, optical density and/or delta E may be determined using a spectrophotometer. Suitable spectrophotometers are available under the trademark X-RITE.

As used herein, "colorant" generally includes pigments or dyes that are visible by eye.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of moulding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrophotographic ink or varnish composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrophotographic ink or varnish composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink or varnish is employed in the electrophotographic process rather than a powder toner. An electrophotographic printing process may involve subjecting the electrophotographic ink or varnish composition to an electric field, e.g. an electric field having a field gradient of 50-400V/μm, or more, in some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be a little above or a little below the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

The present disclosure relates to a transparent electrophotographic varnish composition comprising a charge adjuvant and inorganic filler particles.

The present disclosure also relates to a liquid electrophotographic printing system comprising an electrophotographic ink composition, and an electrophotographic varnish composition as described herein.

The present disclosure also relates to a method of manufacturing an electrophotographic varnish composition, for instance, an electrophotographic varnish composition as exemplified herein. The method comprises heating a thermoplastic resin mixture until the resin has melted; cooling the resin mixture to form resin particles; contacting the resin particles with a charge adjuvant and inorganic filler particles to form composite particles or a mixture of particles; and combining the composite particles or mixture of particles with a carrier fluid to form the electrophotographic varnish composition.

In some examples, the resin particles are ground in the presence of inorganic filler particles and the charge adjuvant to form composite particles. In other examples, the resin particles are ground with the charge adjuvant and then mixed with inorganic filler particles to form a particulate mixture.

The present disclosure also describes a method of forming a varnished image on a substrate. The method comprises electrophotographically printing an image onto a print substrate using at least one electrophotographic ink composition, and, electrophotographically printing an electrophotographic varnish composition comprising a charge adjuvant and inorganic filler particles onto the printed image; wherein the electrophotographic varnish composition is printed in the same print cycle as the at least one electrophotographic ink.

The present disclosure also relates to a print substrate comprising an image formed from at least one layer of electrophotographic ink printed on the substrate, and at least one layer of the electrophotographic varnish composition described herein printed over the at least one layer of electrophotographic ink.

It has been found that some electrophotographic inks do not have the desired degree of durability, for example, in peel, scratch, flaking, or rub tests, when printed on certain print substrates. This can sometimes be addressed by applying an electrophotographic varnish over the printed ink. Such varnishes can improve the durability of the image, for example, by improving its scratch resistance. However, varnishes can decrease the peel resistance of the printed image. It has been found that, by including inorganic filler particles in the electrophotographic varnish composition, the durability of the printed image can be improved. For instance, a desirable balance between scratch resistance and peeling resistance can be obtained. In some examples, the scratch resistance of the printed ink is improved while maintaining a desirable level of peel resistance.

In some examples, the inorganic filler particles have a thermal conductivity of at least 5 W/m·K. In other examples, the inorganic filler particles have a thermal conductivity of at least 30 W/m·K. In certain examples, the inorganic filler particles have a thermal conductivity of 10 to 2000 W/m·K, for instance, 30 to 2000 W/m·K. In some examples, the inorganic filler particles have a thermal conductivity sufficient to conduct external heat from the printing equipment to the printed layers of ink, thereby aiding the drying process. In some examples, the inorganic filler particles have a thermal conductivity that is greater than that of the electrophotographic ink.

The inorganic filler particles may be ceramic particles. For example, the particles may be selected from at least one of barium titanate ($BaTiO_3$), silicon nitride, boron nitride and clays, including, for example, kaolin clay. In some examples, the inorganic filler particles comprise mica particles. In some examples, the inorganic filler particles comprise or are inorganic filler particles of at least one of barium titanate ($BaTiO_3$), silicon nitride, boron nitride and kaolin. In some examples, the inorganic filler particles comprise a combination of at least two different inorganic filler particles. In some examples, the inorganic filler particles comprise inorganic filler particles selected from at least one of silicon nitride, boron nitride and barium titanate in combination with clay particles (e.g clay platelets, for example, kaolin). For example, the inorganic filler particles comprise clay (e.g. clay platelets, for instance, kaolin) and silicon nitride and/or boron nitride. In one example, the inorganic filler particles comprise clay (e.g. kaolin) and boron nitride.

In some examples, the inorganic filler particles constitute from about 0.5 wt % to about 10 wt % of the solids in the electrophotographic varnish composition. In one example, the inorganic filler particles constitute, 1 to 8 wt %, for instance, 1 to 5 wt %, of the solids in the electrophotographic varnish composition. In some examples the inorganic filler particles constitute from about 2 wt % to about 7 wt %, in some examples wt % to 6 wt %, in some examples about 3 wt % to 5 wt %, of the solids in the electrophotographic varnish composition.

The varnish composition is transparent. In other words, the components of the varnish composition and their respective amounts have to be selected such that the varnish composition is transparent. As discussed above, a transparent composition is one that allows light to pass therethrough. For example, the composition allows light to pass through it such that, when the electrophotographic varnish composition is electrographically printed over a printed image of at a thickness of 3 μm or less, for instance, 1.5 to 2 μm (e.g. 1.5 μm), the printed image is clearly visible to the naked eye. In some examples, the electrophotographic varnish composition is transparent, whereby, when the electrophotographic varnish composition is electrographically printed over a printed image of at a thickness of 1.5 μm, the change in optical density of the varnished image is within +/−0.05 of the optical density of the un-varnished image. For avoidance of doubt, the nature of the printed image (e.g. colour or number of layers of ink used to form the image) is immaterial to the measurement of the change of optical density.

Additionally or alternatively, the electrophotographic varnish composition is transparent, whereby, when the electrophotographic varnish composition is electrographically printed over a printed image of at a thickness of 1.5 μm, the colours in the varnished image are substantially the same as the colours in the unvarnished image. By "substantially the same", it is meant that the difference in the colour(s) of the varnished and un-varnished image are small. Reference is made to ASTM D1729-96 (Reapproved 2009, which specifies the equipment and procedures for visual appraisal of colours and colour differences of opaque materials that are diffusely illuminated. In some examples, the delta E (determined according to CIE94) between the colours of the varnished and un-varnished image may be 3 or less, for example, 2 or less. In some examples, the delta E (determined according to CIE94) may be 1.5 or less, for example, 1 or less.

Optical density or absorbance is a quantitative measure expressed as a logarithmic ratio between the radiation falling upon a material and the radiation transmitted through a material.

$$A_\lambda = -\log_{10}\left(\frac{I_1}{I_0}\right),$$

where $A_\lambda$ is the absorbance at a certain wavelength of light ($\lambda$), $I_1$ is the intensity of the radiation (light) that has passed through the material (transmitted radiation), and $I_0$ is the intensity of the radiation before it passes through the material (incident radiation). The incident radiation may be any suitable white light, for example, day light. The optical density or delta E of an image may be determined using methods that are well-known in the art. For example, optical density and/or delta E may be determined using a spectrophotometer. Suitable spectrophotometers are available under the trademark X-RITE.

In some examples, the varnish composition is substantially colourless. The varnish composition may be substantially free from colorant. Where present, the colorant may be present in an amount of 0 to less than 0.5 weight % of the total solids in the composition. For example, the colorant, where present, may be present in an amount of less than 0.2 weight %, for instance, less than 0.1 weight % of the total weight of solids in the varnish composition. In certain examples, colorant is present in an amount of less than 0.05 weight %, for example, less than 0.01 weight % of the total weight of solids in the varnish composition. In some examples, the varnish composition is substantially free from a cyan colorant, a yellow colorant, a magenta colorant and a black colorant.

In some examples, the inorganic filler particles have an average particle size of less than about 50 μm. In some examples, the inorganic filler particles have an average particle size of less than about 20 μm, for instance, less than about 10 μm. In some examples, the inorganic filler particles may take the form of substantially spherical particles. In other examples, the inorganic filler particles are platelets. For example, the inorganic filler particles may or may not be clay platelets. In some examples, the platelet structure can increase peeling resistance of the printed image while retaining a desirable degree of scratch resistance or increase scratch resistance while retaining a desirable degree of peeling resistance. Where the inorganic filler particles are platelets, the platelets may have a maximum dimension of 50 μm or less, for instance, 20 μm or less. In one example, the maximum dimension of the platelet may be 10 μm or less. Maximum dimension is the largest dimension that can be measured across a platelet particle. The particle size may be measured, for example, using a scanning electron micrograph or other techniques.

In the present application, a platelet may have a three dimensional shape with a first dimension, which may be termed a thickness, less than the other two dimensions, each of which are perpendicular to one another and to the first dimension. In some examples, at least some of the platelets have a thickness of at least 0.01 nm, in some examples a thickness of at least 0.05 nm, in some examples a thickness of at least 0.1 nm, in some examples a thickness of at least 0.5 nm, in some examples a thickness of at least 1 nm. In some examples, at least some of the platelets have a thickness of 100 nm or less, in some examples a thickness of 50 nm or less, in some examples a thickness of 20 nm or less, in some examples a thickness of 10 nm or less, in some examples a thickness of 5 nm or less, in some examples a thickness of 3 nm or less, in some examples a thickness of 2 nm or less.

In some examples, at least some of the platelets have a diameter, measured in a direction perpendicular to the thickness and excluding any coating on the platelet, of at least 10 nm, in some examples a diameter of at least 20 nm, in some examples a diameter of at least 50 nm, in some examples a diameter of at least 70 nm, in some examples a diameter of at least 90 nm, in some examples a diameter of at least 100 nm. In some examples, at least some of the platelets have a diameter, measured in a direction perpendicular to the thickness, of 500 nm or less, in some examples a diameter of 300 nm or less, in some examples a diameter of 200 nm or less, in some examples a diameter of 150 nm or less, in some examples a diameter of 120 nm or less.

In some examples, at least some of the platelets have an aspect ratio of a diameter (measured in a direction perpendicular to the thickness) to its thickness of n:1, where n is at least 2, in some examples at least 5, in some examples at least 10, in some examples at least 20, in some examples at least 30, in some examples at least 50, in some examples at least 70, in some examples at least 80, in some examples at least 100. In some examples, at least some of the platelets have an aspect ratio of a diameter (measured in a direction perpendicular to the thickness) to its thickness of n:1, where n is 1000 or less, in some examples n is 500 or less, in some examples n is 200 or less, in some examples n is 60 or less, in some examples n is 150 or less.

Where the inorganic filler particles are platelets, the platelets may comprise or consist essentially of boron nitride, mica or a clay material. Consist essentially of in this context may indicate that the platelets include at least 95 wt % of boron nitride, mica or clay material, in some examples at least 98 wt % boron nitride, mica or clay material, in some examples at least 99 wt % boron nitride, mica or clay material. Suitable clay materials include montmorillonite, kaolinite, halloysite, illite, vermiculite, talc, palygorskite and pyrophyllite. The clay material, which may be modified as described below, or may be uncoated before incorporation into the varnish. In some examples, the clay material is selected from at least one of montmorillonite and kaolinite. In one example, the inorganic filler comprises or consists essentially of kaolin. In some examples, kaolin has been shown to increase flaking and peeling resistance of the printed image while retaining a desirable degree of scratch or rub resistance.

In some examples, the clay material may be modified with a quaternary ammonium salt. In some examples, the quaternary ammonium salt has a group including a C10 to C20 alkyl or alkylene group, in some examples a C12 to C18 alkyl or alkylene group. In some examples, the quaternary ammonium salt has been modified with a hydrogenated tallow or tallow moiety.

Before application to the print substrate in the electrophotographic printing process, the electrophotographic varnish composition is in liquid form. The composition may include a carrier liquid in which are suspended particles of a thermoplastic resin and the inorganic filler particles. Generally, the carrier liquid can act as a dispersing medium for the solid and any dissolved components in the electrophotographic varnish composition. For example, the carrier liquid can include or be a hydrocarbon, silicone oil or vegetable oil. The carrier liquid can include, but is not limited to, an insulating, non-polar, non-aqueous liquid. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In particular, the carrier liquids can include, but are not limited to, ISOPAR™ G, ISOPAR™ H, ISOPAR™ L, ISOPAR™ M, ISOPAR™ K, ISOPAR™ V, NORPAR™ 12, NORPAR™ 13, NORPAR™ 15, EXXOL™ D40, EXXOL™ D80, EXXOL™ D100, EXXOL™ D130, and EXXOL™ D140 (each sold by EXXON CORPORATION); TECLEN N-16™, TECLEN N-20™, TECLEN N-22™, NISSEKI NAPHTHESOL L™, NISSEKI NAPHTHESOL M™, NISSEKI NAPHTHESOL H™, #0 SOLVENT L™, #0 SOLVENT M™, #0 SOLVENT H™, NISSEKI ISOSOL 300™, NISSEKI ISOSOL 400™, AF-4™, AF-5™, AF-6™ and AF-7™ (each sold by NIPPON OIL CORPORATION); IP SOLVENT 1620™ and IP SOLVENT 2028™ (each sold by IDEMITSU PETROCHEMICAL CO., LTD.); AMSCO OMS™ and AMSCO 460™ (each sold by AMERICAN MINERAL SPIRITS CORP.); and ELECTRON™, POSITRON™, NEW II™, PUROGEN™ HF (100% synthetic terpenes) (sold by ECOLINK™).

The carrier liquid can constitute about 20% to 99.5% by weight of the electrophotographic varnish composition, in some examples 50% to 99.5% by weight of the electrophotographic varnish composition. The carrier liquid may constitute about 40 to 90% by weight of the electrophotographic varnish composition. The carrier liquid may constitute about 60% to 80% by weight of the electrophotographic varnish composition. The carrier liquid may constitute about 90% to 99.5% by weight of the electrophotographic varnish composition, in some examples 95% to 99% by weight of the electrophotographic varnish composition.

The varnish when printed on the print substrate may be substantially free from carrier liquid. In an electrophotographic printing process and/or afterwards, the carrier liquid may be removed, e.g. by an electrophoresis processes during printing and/or evaporation, such that substantially just solids are transferred to the print substrate. Substantially free from carrier liquid may indicate that the varnish printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the varnish printed on the print substrate is free from carrier liquid.

The electrophotographic varnish composition and/or the varnish printed on the print substrate can include a thermoplastic resin, which will for brevity be termed a 'resin' herein. The resin may be a resin having acidic side groups. A thermoplastic polymer is sometimes referred to as a thermoplastic resin. In some examples, the polymer of the resin may be selected from ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may be or include a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may include a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer including acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may include two different polymers having acidic side groups. The two polymers having acidic side groups may have different acidities, which may fall within the ranges mentioned above. The resin may include a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may include two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may include a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may include a first polymer having a melt viscosity of 15000 poise or more, in some examples 20000 poise or more, in some examples 50000 poise or more, in some examples 70000 poise or more; and in some examples, the resin may include a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may include a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is NUCREL™ 960 (from DuPont), and example of the second polymer is NUCREL™ 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in electrophotographic varnish composition includes a single type of polymer, the polymer (excluding any other components of the electrophotographic varnish composition) may have a melt viscosity of 6000 poise or more, in some examples a melt viscosity of 8000 poise or more, in some examples a melt viscosity of 10000 poise or more, in some examples a melt viscosity of 12000 poise or more. If the resin includes a plurality of polymers all the polymers of the resin may together form a mixture (excluding any other components of the electrophotographic varnish composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may include two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may include (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may include a polymer having acidic side groups, as described above (which may be free of ester side groups), and a polymer having ester side groups. The polymer having ester side groups may be a thermoplastic polymer. The polymer having ester side groups may further include acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the BYNEL® class of monomer, including BYNEL® 2022 and BYNEL® 2002, which are available from E.I. du Pont de Nemours and Co.

The polymer having ester side groups may constitute 1% or more by weight of the total amount of the resin polymers, e.g. thermoplastic resin polymers, in the electrophotographic varnish composition and/or the varnish printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the electrophotographic varnish composition and/or the varnish printed on the print substrate. The polymer having ester side groups may constitute from 5% to 50% by weight of the total amount of the resin polymers, e.g. thermoplastic resin polymers, in the electrophotographic varnish composition and/or the varnish printed on the print substrate, in some examples 10% to 40% by weight of the total amount of the resin polymers, e.g. thermoplastic resin polymers, in the electrophotographic varnish composition and/or the varnish printed on the print substrate, in some examples 5% to 30% by weight of the total amount of the resin polymers, e.g. thermoplastic resin polymers, in the electrophotographic varnish composition and/or the varnish printed on the print substrate, in some examples 5% to 15% by weight of the total amount of the resin polymers, e.g. thermoplastic resin polymers, in the electrophotographic varnish composition and/or the varnish printed on the print substrate in some examples 15% to 30% by weight of the total amount of the resin polymers, e.g. thermoplastic resin polymers, in the electrophotographic varnish composition and/or the varnish printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the NUCREL™ family of toners (e.g. NUCREL 403™, NUCREL 407™, NUCREL 609HS™ NUCREL 908HS™, NUCREL 1202HC™, NUCREL 30707™, NUCREL 1214™, NUCREL 903™, NUCREL 3990™, NUCREL 910™, NUCREL 925™, NUCREL 699™, NUCREL 599™, NUCREL 960™, NUCREL RX 76™, NUCREL 2806™, BYNEL® 2002, BYNEL® 2014, and BYNEL® 2020 (sold by E. I. du Pont de Nemours and Co.)), the ACLYN™ family of toners (e.g. ACLYN™ 201, ACLYN™ 246, ACLYN™ 285, and ACLYN™ 295), and the LOTADER™ family of toners (e.g. LOTADER™ 2210, LOTADER™ 3430, and LOTADER™ 8200 (sold by Arkema)).

The resin can constitute about 5 to 99.5%, in some examples about 50 to 80%, by weight of the solids of the electrophotographic varnish composition and/or the varnish printed on the print substrate. The resin can constitute about 60 to 95%, in some examples about 70 to 95%, by weight of the solids of the electrophotographic varnish composition and/or the varnish printed on the print substrate.

In one example, the resin comprises a high melt viscosity ethylene acrylic acid copolymer resin and a high acid ethylene acrylic acid copolymer resin having an acid content of at least 15 weight % and a viscosity of at least 8000 poise, wherein the electrophotographic varnish composition has a total resin acidity of at least 15 weight % and a total resin melt viscosity of at least 20,000 poise. Suitable resins are described in U.S. Pat. No. 8,980,518 (which corresponds with WO 2012/105952), which is incorporated herein by reference.

In some more specific examples, the high acid ethylene acrylic acid copolymer resins described herein have an acid content of at least 18 wt %. In another example, the high acid ethylene acrylic acid copolymer resin can have an acid content of at least 20 wt %. In still another example, the high melt viscosity ethylene acrylic acid copolymer resin can have a melt viscosity of at least 20,000 poise, for instance, at least 100,000 poise, or in some examples, at least 200,000 poise. The high melt viscosity ethylene acrylic acid copolymer resin and/or the high acid ethylene acrylic acid copolymer resin can also both have a molecule weight ($M_w$) of at least 40,000.

Generally, the high melt viscosity ethylene acrylic acid copolymer resin and the high acid ethylene acrylic acid copolymer resin are present in such an amount to allow compatibility between the copolymers. As such, the copolymers can be added in corresponding amounts such that they can mix and, in some examples, encapsulate the inorganic filler during processing to form the electrophotographic varnish composition. In one example, the high melt viscosity ethylene acrylic acid copolymer resin and the high acid ethylene acrylic acid copolymer resin can be present in the electrophotographic varnish composition at a ratio of 10:1 to 1:10 by weight. In another example, the high melt viscosity ethylene acrylic acid copolymer resin and the high acid ethylene acrylic acid copolymer resin can be present in the electrophotographic varnish composition at a ratio of 8:2 to 6:4 by weight. Generally, the high melt viscosity ethylene acrylic acid copolymer resin can be present in the electrophotographic varnish composition at an amount of about 5 wt % to about 50 wt %. Additionally, the high acid ethylene acrylic acid copolymer resin can be present in the varnish in an amount of about 1 wt % to about 40 wt %.

The electrophotographic varnish composition and/or varnish printed on the print substrate can include a charge director. A charge director can be added to an electrophotographic varnish composition to impart a charge of a desired polarity and/or maintain sufficient electrophotographic charge on the particles of an electrophotographic varnish composition. The charge director may include ionic compounds, including, but not limited to, metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral calcium PETRONATE™, neutral barium PETRONATE™, and basic barium PETRONATE™), polybutylene succinimides (e.g. OLOA™ 1200 and AMOCO 575), and glyceride salts (e.g. sodium salts of phosphated mono- and diglycerides with unsaturated and saturated acid substituents), sulfonic acid salts including, but not limited to, barium, sodium, calcium, and aluminium salts of sulfonic acid. The sulfonic acids may include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrophotographic varnish composition.

The charge director can include a sulfosuccinate moiety of the general formula $[R_a—O—C(O)CH_2CH(SO_3^-)C(O)—O—R_b]$, where each of $R_a$ and $R_b$ is an alkyl group. In some examples, the charge director includes nanoparticles of a simple salt and a sulfosuccinate salt of the general formula $MA_R$, wherein M is a metal, n is the valence of M, and A is an ion of the general formula $[R_a—O—C(O)CH_2CH(SO_3^-)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_R$ is an example of a micelle forming salt. The charge director may be substantially free or free of an acid of the general formula HA, where A is as described above. The charge director may include micelles of said sulfosuccinate salt enclosing at least some of the nanoparticles. The charge director may include at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may include a cation selected from Mg, Ca, Ba, $NH_4$, tert-butyl ammonium, $Li^+$, and $Al^{+3}$, or from any sub-group thereof. The simple salt may include an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director may further include basic barium petronate (BBP).

In the formula $[R_a—O—C(O)CH_2CH(SO_3^-)C(O)—O—R_d]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3^-)C(O)—O—R_b]$ and/or the formula $MA_n$ may be as defined in any part of WO2007130069.

The charge director may include (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In an electrophotographic varnish composition, the charge director can constitute about 0.001% to 20%, in some examples 0.01 to 20% by weight, in some examples 0.01 to 10% by weight, in some examples 0.01 to 1% by weight of the solids of the electrophotographic varnish composition and/or varnish printed on the print substrate. The charge director can constitute about 0.001 to 0.15% by weight of the solids of the electrophotographic varnish composition and/or varnish printed on the print substrate, in some examples 0.001 to 0.15%, in some examples 0.001 to 0.02% by weight of the solids of the electrophotographic varnish composition and/or varnish printed on the print substrate. In some examples, the charge director imparts a negative charge on the electrophotographic varnish composition. The particle conductivity may range from 50 to 500 pmho/cm, in some examples from 200-350 pmho/cm.

The electrophotographic varnish composition and/or varnish printed on the print substrate includes a charge adjuvant. A charge adjuvant acts to increase and/or stabilise the charge on particles, e.g. resin-containing particles, of an electrophotographic varnish composition. The charge adjuvant may be a metal salt of an organic acid. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the electrophotographic varnish composition and/or varnish printed on the print substrate. The charge adjuvant can constitute about 0.5 to 4% by weight of the solids of the electrophotographic varnish composition and/or varnish printed on the print substrate. The charge adjuvant can constitute about 1 to 3% by weight of the solids of the electrophotographic varnish composition and/or varnish printed on the print substrate.

In some examples, the electrophotographic varnish composition can have a conductivity of less than about 200 pS/cm, or, in another example, even less than about 100 pS/cm.

In some examples, the electrophotographic varnish composition may be manufactured by mixing a carrier fluid, a high acid ethylene acrylic acid copolymer resin having an acid content of at least 15 wt % and a melt viscosity of at least 8000 poise, and a high melt viscosity ethylene acrylic acid copolymer resin having a melt viscosity of at least 20,000 poise to form a resin mixture; heating the resin mixture until the copolymers have melted; cooling the resin mixture to form composite resin particles; grinding the resin particles, for example, with the inorganic filler and charge adjuvant to form composite particles, e.g., of filler, charge adjuvant and resin; and combining the composite particles with the carrier fluid to form the electrophotographic varnish composition. In other examples, the resin is ground with the charge adjuvant and filler was added and mixed inside reactor at controlled temperature (e.g. 30 to 100° C., for example, from 50 to 90° C.) and highshear mixing. The composite particles may have a melting point of 30 to 100° C., for example, from 50 to 90° C. Such melting points can allow for desired film formation during printing. Additionally, a wax may be included in the electrophotographic varnish composition. The wax can be used to help to provide the desired melting point. For example, when used, the wax may be present in an amount of up to 5 weight % of the solids of the varnish composition. While the present method steps are listed sequentially, it is understood that such steps are not necessarily performed in the recited order. For example, in one example, the step of mixing a carrier fluid, a high acid ethylene acrylic acid copolymer resin, and a high melt viscosity ethylene acrylic acid copolymer resin, and the step of heating can be performed simultaneously.

As discussed above, the electrophotographic varnish composition described herein is intended to be applied to an image printed using an electrophotographic ink composition. Any suitable electrophotographic ink composition may be employed. For example, the ink composition may include at least one thermoplastic resin, a colorant and a liquid carrier. The colorant is a colorant that is visible to the human eye. In other words, the colorant absorbs light in the visible part of the electromagnetic spectrum. The colorant imparts a hue or colour to the printed image. Suitable resins and carriers are described in relation to the electrophotographic varnish composition above. For the avoidance of doubt, the electrophotographic ink composition may comprise the thermoplastic resin(s) and/or carrier in the amounts described in relation to the electrophotographic varnish composition above.

Prior to printing, the electrophotographic ink is, in some examples, a liquid electrophotographic ink. The liquid electrophotographic ink may comprise a carrier; a colorant (e.g. pigment); a high melt viscosity ethylene acrylic acid copolymer resin; and a high acid ethylene acrylic acid copolymer resin having an acid content of at least 15 weight % and a viscosity of at least 8000 poise; wherein the liquid electrophotographic ink has a total resin acidity of at least 15 weight % and a total resin melt viscosity of at least 20,000 poise. In some more specific examples, the high acid ethylene acrylic acid copolymer resins described herein have an acid content of at least 18 wt %. In another example, the high acid ethylene acrylic acid copolymer resin can have an acid content of at least 20 wt %. In still another example, the high melt viscosity ethylene acrylic acid copolymer resin can have a melt viscosity of at least 20,000 poise, for instance, at least 100,000 poise, or in some examples, at least 200,000 poise. The high melt viscosity ethylene acrylic acid copolymer resin and/or the high acid ethylene acrylic acid copolymer resin can also both have a molecule weight ($M_w$) of at least 40,000. Suitable inks are described in WO 2012/105952, which is incorporated herein by reference.

Generally, the high melt viscosity ethylene acrylic acid copolymer resin and the high acid ethylene acrylic acid copolymer resin are present in such an amount to allow compatibility between the copolymers. As such, the copolymers can be added in corresponding amounts such that they can mix and encapsulate colorant(s) (e.g. pigment(s)) during processing to form the electrophotographic ink composition. In one example, the high melt viscosity ethylene acrylic acid copolymer resin and the high acid ethylene acrylic acid copolymer resin can be present in the electrophotographic ink composition at a ratio of 10:1 to 1:10 by weight. In another example, the high melt viscosity ethylene acrylic acid copolymer resin and the high acid ethylene acrylic acid copolymer resin can be present in the electrophotographic ink composition at a ratio of 8:2 to 6:4 by weight. Generally, the high melt viscosity ethylene acrylic acid copolymer resin can be present in the electrophotographic ink composition at an amount of about 5 wt % to about 50 wt %. Additionally, the high acid ethylene acrylic acid copolymer resin can be present in the ink in an amount of about 1 wt % to about 40 wt %. The electrophotographic ink composition may include wax and/or charge director(s).

The electrophotographic ink comprises colorant (e.g. one visible to the naked eye), for example, at least one of a cyan colorant, a yellow colorant, a magenta colorant and a black colorant. In some examples, the electrophotographic ink composition and/or ink printed on the print substrate includes a colorant selected from a pigment, dye and a combination thereof. In one example, the colorant is a pigment. The colorant may be unicolor or composed of any combination of available colours. The colorant may be selected from a cyan colorant, a yellow colorant, a magenta colorant and a black colorant. The electrophotographic ink composition and/or ink printed on the print substrate may include a plurality of colorants. The electrophotographic ink composition and/or ink printed on the print substrate may include a first colorant and second colorant, which are different from one another. Further colorants may also be present with the first and second colorants. The electrophotographic ink composition and/or ink printed on the print substrate may include first and second colorants where each is independently selected from a cyan colorant, a yellow colorant, a magenta colorant and a black colorant. In some examples, the first colorant includes a black colorant, and the second colorant includes a non-black colorant, for example a colorant selected from a cyan colorant, a yellow colorant and a magenta colorant. The colorant may be selected from a phthalocyanine colorant, an indigold colorant, an indanthrone colorant, a monoazo colorant, a diazo colorant, inorganic salts and complexes, dioxazine colorant, perylene colorant, anthraquinone colorants, and any combination thereof.

The colorant (e.g. pigment) may be present ink the electrophotographic ink composition in an amount of 8 to 25, for example, 10 to 18 weight % based on the total weight of solids in the ink composition.

The present disclosure also relates to a method of forming a varnished image on a substrate. The method comprises electrophotographically printing an image using at least one electrophotographic ink composition onto a substrate, and electrophotographically printing an electrophotographic varnish composition to the printed image on the substrate in the same printing cycle. The image formed using an electrophotographic ink composition may be an image formed using at least one of a cyan colorant, a yellow colorant, a magenta colorant and a black colorant. One or several layers of ink may be employed to form the image. One or more colorants may be employed.

Any suitable method of electrophotographic printing may be used. For example, a latent electrostatic image may be formed on a surface. The surface may then be contacted with an electrophotographic ink or varnish composition to form a developed image on the surface. The developed image may then be transferred to a substrate to form a printed and/or varnished image on the substrate.

The surface on which the latent electrostatic image is formed may be on a rotating member, e.g. in the form of a cylinder. The surface on which the latent electrostatic image is formed may form part of a photo imaging plate (PIP). The contacting may involve passing the electrophotographic ink or varnish composition between a stationary electrode and a rotating member, which may be a member having the surface having a latent electrostatic image thereon or a member in contact with the surface having a latent electrostatic image thereon. A voltage is applied between the stationary electrode and the rotating member, such that the particles adhere to the surface of the rotating member. This may involve subjecting the electrophotographic ink or varnish composition to an electric field having a field gradient of 50-400V/μm, or more, in some examples 600-900V/μm, or more.

The intermediate transfer member may be a rotating flexible member, which is in some examples heated, e.g. to a temperature of from 80 to 160° C., in some examples from 90 to 130° C., in some examples from 100 to 110° C.

The electrophotographic varnish composition may be applied to the substrate at any suitable thickness. For example, the varnish may be applied in a layer(s) that is up to 3 microns thick, for example, up to 2 microns thick. The electrophotographic varnish composition may be applied in a layer(s) of at least 0.8 microns thick, for example, at least 1 micron thick. In some examples, the electrophotographic varnish composition is applied in a layer(s) that is 1.5 to 2 microns thick.

The print substrate, before having been printed with the ink, may be any suitable substrate. The print substrate may be any suitable substrate capable of having an image printed thereon. The print substrate may include a material, which may be termed a print material, selected from an organic or inorganic material. The print material may include a natural polymeric material, e.g. cellulose. The print material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a non-cellulosic polymer, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print substrate. In some examples, the substrate is a gloss print substrate, in some examples a glossy paper.

Generally, the present methods, compositions, and systems provide a varnish that is durable and scratch resistant when printed. Scratch resistance testing can be performed by a TABER® Shear & Scratch tester model no. 551 using a contour shear tool (precision ground tungsten carbide has a cutting edge lapped to a 25 mm radius with a 30° clearance S-20. The edge is set at a 22° shear angle in relation to the rotation of the table). The electrophotographic varnish composition of the present disclosure can also maintain excellent adhesion. The adhesion can be measured by an adhesion test where an adhesive tape (3M SCOTCH® Drafting Tape 230) can be applied to printed ink. The tape can be peeled from the substrate, e.g. paper, and the % of the damaged area can be measured by scanning the tested print area and comparing it to a non-damaged area.

EXAMPLES

The following illustrates examples of the methods and other aspects described herein. Thus, these Examples should not be considered as limitations of the present disclosure, but are merely in place to teach how to make examples of the present disclosure.

Materials

Inorganic Filler Particles:

The inorganic filler primary particles have a particle size of 25-100 nm for circular particles. For platelet particles, the particles have a thickness of 1-50 nm and length of 1-8 micron.

In the Examples below, the following specific inorganic filler particles were used:

Boron Nitride (BN)
Silicon Nitride (SN)
Kaolin Clay
Barium Titanate ($BaTiO_3$)

Resins/Other Components:

Resins:

NUCREL™ 925 [Resin N] from Dupont—copolymer of ethylene and methacrylic acid, made with nominally 15 wt % methacrylic acid.

NUCREL™ 2806 [Resin L19] from Dupont—copolymer of ethylene and methacrylic acid, made with nominally 18 wt % methacrylic acid BYNEL® 2022 [Resin T22] from Dupont—acid modified ethylene acrylate resins, 10% wt % acrylic acid.

Additives:

VCA [Sigma Aldrich]— Aluminum stearate as charge adjuvant to capture charge director molecules Electrophotographic Varnish Preparation Procedure:

First, a "paste" of molten resins and ISOPAR™ was prepared on a laboratory scale "Ross" mixer using a procedure which involved mixing raw material resins and ISOPAR™ L. The procedure began with raising the temperature of a mixture of 40% of resin and 60% ISOPAR™ to 130° C. (266° F.) in the mixer at a mixing speed of 50 Hz. The resins used were NUCREL™ 925, NUCREL™ 2806 and BYNEL® 2022 in the weight ratio of 8:2:1. After an hour and a half the mixer speed was raised to 70 Hz and the mixture then mixed at this speed for another hour. The next stage involved stopping the heating and reducing the mixer speed back to 50 Hz. This allowed the paste to cool to room temperature. After that, the paste was ground with ISOPAR™ and VCA. The grinding speed was 250 RPM and the grinding was carried out for 12 hours at 30° C. Inorganic filler particles were included in grinding unless otherwise indicated. The varnish composition was ready after grinding. The varnish composition was charged using a charge director prior to printing.

Image Printing

The varnish was printed on coloured image assembled by YMCK (yellow, magenta, cyan and key [i.e. black]) separation or part of them at a desired sequence. The ink that used to build the image was the commercially available ELECTROINK® 4.5.

Test Methods:

Peeling—job printed at 300%. The operator waits 10 min and then applies standard adhesive tape on specific location, then clip the tape with heavy roller (coated with rubber) on top of print. After 10 repetitions operator peel of the tape off image and damage is evaluated by scanning software (ink peeled off).

Scratch—prints of circles at 400% printed, after two days samples are taken to TABER® shear/scratch tester model 551. Tungsten carbide tip is installed to cause damage to print when print is fixed on iron plate. Scratch movement occurs like "phonograph" as circular scratch which evaluated by debris collected and weight.

Reference Example 1

An electrophotographic ink composition was printed on a substrate (coated paper, EUROART 135 gsm) to create an image using the electrographic ink composition that was described above. The scratch resistance and peeling resistance of a printed ink were determined. The results are explained with reference to Table 2 below.

Reference Example 2

An electrophotographic ink composition was printed on a substrate as described in Reference Example 1. A standard electrophotographic varnish composition was then electrophotographically printed over the ink in the same print cycle. The standard electrophotographic varnish composition was prepared as described above but was devoid of inorganic filler particles. The scratch resistance and peeling resistance of the varnished ink was determined. The results are explained with reference to Table 2 below.

Examples 3 to 6

In Examples 3 to 6, Reference Example 2 was repeated except that inorganic filler particles were added to the working dispersion.

Table 1 summarises the key features of the compositions that were tested:

TABLE 1

| | Electrophotographic Varnish Composition | Inorganic Filler Particles (weight % based on the total weight of solids in the composition) |
|---|---|---|
| Reference Example 1 | None | N/A |
| Reference Example 2 | Yes | None |
| Example 3 | Yes | 2.5 weight % BN |
| Example 4 | Yes | 2.5 weight % SiN |
| Example 5 | Yes | 2.5 weight % kaolin clay |
| Example 6 | Yes | 2.5 weight % $BaTiO_3$ |

The scratch resistance and peeling resistance of Examples 3 to 6 were determined. As shown in Table 2 below, the scratch resistance and peeling resistance of the Examples were determined. The scratch resistance was evaluated in terms of the mass of debris collected following the scratch test described above. The peeling resistance was evaluated according to the peeling test described above.

TABLE 2

| | Scratch Resistance (μgr) | Peel Resistance (% left of 300% coverage) |
|---|---|---|
| Reference Example 1 | 492 | 97 |
| Reference Example 2 | 70 | 84 |
| Example 3 | 25 | 91 |
| Example 4 | 15 | 87 |
| Example 5 | 70 | 99 |
| Example 6 | 13 | 75 |

The printed unvarnished ink of Reference Example 1 showed poor scratch resistance but good peel resistance as there was only one layer of print on the substrate. In Reference Example 2 an electrophotographic varnish composition was applied to the image of Reference Example 1. This application of varnish improved the scratch resistance of the image. However, the peel resistance decreased. This was believed to be caused by the existence of an additional layer of print. By including inorganic filler particles in the electrophotographic varnish composition, improvements in scratch resistance and/or peel resistance were achieved. With BiN (Example 3), an improvement in scratch and peel resistance was observed relative to the standard varnish of Reference Example 2. With SiN (Example 4), an improvement in scratch resistance and peel resistance was observed relative to that observed with that of Reference Example 2. The addition of kaolin clay (Example 5) improved the peel resistance significantly over the peel resistance observed in the absence of any inorganic filler (Reference Example 2). The scratch resistance was comparable to that of the standard varnish of Reference Example 2. The addition of the $BaTiO_3$ (Example 6) significantly improved the scratch resistance over that observed in the absence of any filler (Reference Example 2). The peel resistance was slightly worse than that observed in Reference Example 2 but nevertheless acceptable for certain print applications.

The invention claimed is:

1. A transparent electrophotographic varnish composition comprising:

a carrier liquid; and composite particles of a resin, a charge adjuvant, and inorganic filler platelets selected from the group consisting of kaolin clay, boron nitride, and combinations thereof, wherein the inorganic filler platelets have an aspect ratio of diameter to thickness ranging from 1000:1 to 2:1.

2. The composition according to claim 1, which comprises 0.5 to 10 weight % of said inorganic filler platelets based on the total weight of solids in the composition.

3. The composition according to claim 1, wherein the inorganic filler platelets have a thermal conductivity of at least 5 W/m·K.

4. The composition according to claim 1, wherein the inorganic filler platelets comprise a combination of the kaolin clay and the boron nitride.

5. The composition according to claim 1, which comprises from 0 to up to 0.2 weight % colorant based on the total weight of solids in the composition.

6. The composition according to claim 1, wherein:

the resin of the composite particles comprises:

a high melt viscosity ethylene acrylic acid copolymer resin having a melt viscosity of at least 20,000 poise; and a high acid ethylene acrylic acid copolymer resin having an acid content of at least 15 weight % and a viscosity of at least 8000 poise; and the liquid electrophotographic varnish composition has a total resin acidity of at least 15 weight % and a total resin melt viscosity of at least 20,000 poise.

7. The composition according to claim 6, wherein the high melt viscosity ethylene acrylic acid copolymer resin and high acid ethylene acrylic acid copolymer resin are present in the liquid electrophotographic varnish composition in a ratio of 10:1 to 1:10 by weight.

8. The composition according to claim 6, which comprises about 5 to about 50 weight % of the high melt viscosity ethylene acrylic acid copolymer resin and about 1 to about 40 weight % of the high acid ethylene acrylic acid copolymer resin based on the total weight of solids in the composition.

9. The composition according to claim 1, which further comprises a charge director.

10. A liquid electrophotographic printing system comprising:

an electrophotographic ink composition, and the transparent electrophotographic varnish composition according to claim 1.

11. A print substrate comprising an image formed from at least one layer of electrographic ink printed on the substrate, and at least one layer of the transparent electrographic varnish composition according to claim 1 printed over the electrographic ink.

12. The composition according to claim 1 wherein the thickness ranges from 1 nm to 50 nm and the diameter ranges from 1 μm to 8 μm.

13. The composition according to claim 1 wherein the thickness ranges from 0.01 nm to 100 nm and the diameter ranges from 20 nm to 300 nm.

14. The composition according to claim 1, further comprising a wax present in an amount of up to 5 wt % based on the total weight of solids in the composition.

15. The composition according to claim 1, wherein the inorganic filler platelets comprises the kaolin clay and wherein the composition further comprises inorganic filler particles selected from group consisting of silicon nitride and barium titanate.

16. A method of manufacturing an electrophotographic varnish composition, said method comprising:

heating a thermoplastic resin mixture until the resin has melted;

cooling the resin mixture to form resin particles;

contacting the resin particles with a charge adjuvant and inorganic filler platelets to form composite particles, wherein the inorganic filler platelets are selected from the group consisting of kaolin clay, boron nitride, and combinations thereof, wherein the inorganic filler platelets have an aspect ratio of diameter to thickness ranging from 1000:1 to 2:1; and combining the composite particles with a carrier fluid to form the electrophotographic varnish composition.

17. The method according to claim 16, wherein the resin particles are also contacted with inorganic filler particles selected from group consisting of silicon nitride and barium titanate.

* * * * *